US007739935B2

(12) United States Patent
Schöpfer

(10) Patent No.: US 7,739,935 B2
(45) Date of Patent: Jun. 22, 2010

(54) LATERAL SEPARATING DEVICE FOR PAPER WEBS

(75) Inventor: Patrick Schöpfer, Heitenried (CH)

(73) Assignee: Kern AG, Konolfingen (CH)

( * ) Notice: Subject to any disclaimer, the term of this patent is extended or adjusted under 35 U.S.C. 154(b) by 481 days.

(21) Appl. No.: 11/663,639

(22) PCT Filed: Sep. 27, 2004

(86) PCT No.: PCT/CH2004/000601

§ 371 (c)(1),
(2), (4) Date: Mar. 23, 2007

(87) PCT Pub. No.: WO2006/034596

PCT Pub. Date: Apr. 6, 2006

(65) Prior Publication Data

US 2008/0148912 A1 Jun. 26, 2008

(51) Int. Cl.
*B26D 1/01* (2006.01)
*B65H 35/04* (2006.01)

(52) U.S. Cl. ..... 83/336; 83/65

(58) Field of Classification Search ..... 83/336, 83/64, 65, 13; 226/18, 19, 24, 28, 32; 493/194, 493/196

See application file for complete search history.

(56) References Cited

U.S. PATENT DOCUMENTS 5,104,104 A * 4/1992 Mol ..... 270/52.08
5,768,959 A * 6/1998 Lorenzo ..... 83/74
6,125,730 A * 10/2000 Jacques ..... 83/408
7,255,030 B2 * 8/2007 Benjaminsson ..... 83/13
2003/0089209 A1 * 5/2003 Brueckel et al. ..... 83/76.6

FOREIGN PATENT DOCUMENTS

| | | |
|---|---|---|
| DE | 100 11 006 | 9/2001 |
| EP | 1044915 | * 10/2000 |
| EP | 1123797 | * 8/2001 |
| EP | 1 268 329 | 1/2003 |
| WO | WO 01/66448 | 9/2001 |

* cited by examiner

*Primary Examiner*—Stephen Choi
(74) *Attorney, Agent, or Firm*—The Nath Law Group; Jerald L. Meyer; Jiaxiao Zhang

(57) ABSTRACT

A device for the lateral separation of paper webs, including: a paper introduction region with at least one driven web supply roller; a buffer region, in which the web is prepared for discontinuous forward motion; a cutting device; and a paper lead-off region with discontinuous web forward motion; the device further including at least a first tube group having two tubes which may be moved relative to at least a third tube of the tube group, perpendicular to the web. The tube group (120; 150) is arranged intermediate the paper introduction region having merger region tubes and a discontinuously driven paper web roller in order to form a turning web loop of varying length. The length as determined by the separation between the tubes of the tube group is regulated by a controller, in connection with the driven web supply roller and the discontinuous web forward motion.

5 Claims, 4 Drawing Sheets

LATERAL SEPARATING DEVICE FOR PAPER WEBS

The present invention generally relates to a lateral separating device for paper webs and, in particular, to a device in the buffer region of the lateral separating device where the paper web or the paper webs are prepared for the discontinuous forward motion and are subsequently cut.

BACKGROUND

These cutting devices have been known for some time. They are mainly employed for cutting printed paper webs such as those that are required by larger companies in the finance or insurance industry. These are high performance paper processing lines that typically include high speed printers, power cutting devices as well as sorting and optionally enveloping devices and that are directed to a mostly automated operation.

In order to ensure the safe operation at such high turnovers and speeds a number of precautions need to be taken. For example, the calm and safe guidance of the paper web is of central importance. Another problem is the introduction of the paper into the cutting device. In order to conduct a safe lateral paper separation with sufficient quality for all purposes that should not show any traces of paper rupture the paper web must be halted for a short moment prior to and during its lateral separation. Consequently, it follows that the paper web is moved at different speeds at the location of the lateral separation device or experiences different phases of movement. Next to a phase of constant speed that may be short or even absent during practical operation, phases of acceleration as well as a phase of braking to a complete stop are also required. This results in an average speed that corresponds to the speed of paper introduction and equals the operation speed of a continuously working device.

Because these high performance paper processing lines should operate mostly continuously and without interruption, measures must be taken to accumulate the paper web in a certain region of the processing line or the cutting device (braking or stopping phase) in order to reduce the accumulated material subsequent to the effected lateral separation during an acceleration phase and to continue with normal motion (constant speed). When doing this one has to ensure that the acceleration phase does not last too long because ruptures of the paper web could occur.

From DE 100 11 006 a device for cutting paper webs with a pneumatic paper retarding device is known, where the paper web is guided by means of an air stream acting from below the web through a loop directed upwards.

The web retardation of a device for cutting paper webs described in EP 1 268 329 and WO 01/66448 relies on the above principle.

It is unsatisfactory for these known devices that the accumulated paper web is unguided for a moment and because of this it can make uncontrolled movements upon subsequent acceleration. A further disadvantage is that in this manner only one paper web can be retarded at a time.

It is therefore a first object of the invention to offer a device, wherein the paper web is guided loosely despite its accumulation, i.e. without too much tension, actually being in contact with a mechanical guide means at all times. According to the invention this object is solved while at the same time avoiding the disadvantages of the state of the art by a first embodiment of the invention.

The invention also relates to a method for the lateral separation of fast moving paper webs.

Applicant's investigations leading to the present invention have demonstrated that it is actually possible to increase the turnover of such a processing line even further by employing wider paper webs that are separated longitudinally prior to being introduced to the lateral separating device. For this purpose the paper web is initially introduced to a longitudinal separating device, i.e. before entering the buffer region of the device, which cuts the paper web in machine direction and produces two paper webs arranged on top of each other of half the width of the paper web. By mechanical measures it is ensured that that both partial webs run synchronically so that their further processing can be done simultaneously. Subsequently, both partial webs are guided to the buffer region. There the webs are slowed down independently of one another and accumulated and again accelerated.

In order to optimally benefit from such a longitudinal separating device it is necessary to introduce both formed partial webs simultaneously into the cutting device or its own cutting devices. When doing this the problem must be solved that the device for accumulating the paper web in the buffer region of the processing line cannot serve both partial webs at the same time und would therefore have to be provided twice, thus leading to a significant additional effort for its design, this not having been cost-effective for devices of the state of the art. Furthermore, the requirement of synchronized movement of the partial webs poses an unsolved problem.

Hence, it is a second object of the invention to provide a relatively simple design for the device in the buffer region of the processing line that can process both partial webs at the same time while minimizing the risks of loosing synchronicity, i.e. the synchronous movement of the webs, this being achieved with the embodiments.

Skilled people in the art designate the number of partial webs as group size. If the paper web is separated longitudinally once, the group size is 2. However, it is another object of the invention to provide a design for the buffer region that can also process group sizes larger than 2 or even odd groups. With odd group sizes it can be the case that only one paper web is moved forward. In this case the difference in length of the lower and upper paper web is compensated by the buffer.

In general the present invention offers a device and a method for the lateral separation of paper webs, comprising a paper introduction region, which optionally may include a longitudinal separation device for longitudinally separating the paper web into two partial webs, a buffer region, where at least one web is prepared for the discontinuous forward motion, a controller, a cutting device and a paper lead-off region. The paper introduction region optionally includes a longitudinal separation device with a cutting means that is arranged at the desired location of separation, typically in the middle of the device, the exact position of the cutting means being finely adjustable. The region for the paper introduction comprises the driven web supply roller(s) for supplying the paper web or the partial paper webs. The paper introduction region is positioned at that location of the processing line where—depending on the specific embodiment—the original paper web is introduced or at the exit of the device for the longitudinal separation of the paper web, where both partial webs are introduced for further processing.

The buffer region that is arranged between the paper introduction region and the paper lead-off region comprises one tube group with two tubes that are movable relative to at least one third tube perpendicular to the web. The tubes of this group are more like tubes or tubular surfaces on which the paper web glides. This tube group is arranged between the continuously or discontinuously driven web supply roller and the discontinuously driven web feed in order to form a double turning web loop of variable length. The length of this web loop, that is determined by the distance between the tubes of the tube group, is controlled by a controller. By moving the movable tubes away from the stationary tubes the device adapts to the double format length of the lateral separating device. Because no driven tubes participate in this action and instead the paper webs are dragged over smooth tube surfaces no undesired or erroneous pulling or dragging of the web occurs that would involve the danger of rupture. In contrast to the devices of the state of the art no air is blown into the web loop for it not to collapse but instead the loop is guided by means of at least three non-driven tubes making up a tube group, where the guidance is dictated by the additional paper material present. The control of the aims with the movable tube is the task of the controller.

A paper web being termed as "fast moving" in accordance with the invention is one working satisfactorily at a speed of at least about 120 meters per minute (m/min), preferably at least about 160 m/min and, in particular, in the range of about 180 to 210 m/min. The term "about" used in this context is meant to designate a deviation range of ±20%.

A speed in the latter mentioned range allows for a cutting frequency of about 40000 cuts per hour during operation, the use of two webs bringing this to twice the number of documents.

If the processing line has an upstream longitudinal separation device, the above mentioned device must be present twice in the buffer region, one for each partial web. According to the invention this is solved by arranging a laterally reversed but otherwise identical tube group, which also comprises at least three stationary tubes, adjacent to the first group, so that the carrier means to which these tube groups are attached are arranged symmetrically to the plane and each encompasses an angle of about 75° together with the paper web.

The controller is connected to the continuously or discontinuously driven web supply roller and the discontinuous web forward motion and calculates the necessary spreading of the movable tubes from the difference in forward motion. Furthermore, the controller determines the continuous web forward speed (for the continuous forward motion) and initiates the discontinuous web forward motion that is coordinated with the cutting operation.

The paper web stops for the cutting operation. At this point in time the paper webs moved by the continuous or discontinuous web supply have accumulated and the movable tube pairs of the tube groups move away from the stationary tubes to take up the accumulated material. Their guides are tilted a little from the line vertical to the paper moving direction towards the cutting device. When each of the tube groups has picked up paper of a predetermined length l from a side to be cut, the cutting step is effected and the discontinuous web feed motion starts again and accelerates the webs to a higher speed than the continuous or discontinuous web feed in minimal time. At the same time the tube groups move together again and release the accumulated material. The acceleration of this synchronized web forward motion is calculated so that it reaches the continuous or discontinuous web speed or switches to the braking phase at that point, when the complete accumulated reserve is stretched. Then, a further braking is initiated to take up the web length l before a next cut is initiated, where both partial webs are separated simultaneously.

The continuous or discontinuous web supply is accomplished by two adjacently positioned driven rollers that are located before to the buffer region. The discontinuous paper forward motion is accomplished by the driven rollers in the web lead-off region following the buffer region.

A piece of paper passing the lead-off device after lateral separation is not processed further and will now, for example, be placed alone or with other separated paper pieces in an envelope or is collected together with further separated paper pieces in a stack for packaging purposes. However, these further steps are well known to the skilled person in this field and do not require any further explanation. Also, they are not part of this invention.

A general advantage of the present invention is the possibility to process paper webs continuously with high throughput. A further advantage is that the synchronized forward motion mechanism does not affect the whole web but only the accumulated parts of the paper webs. This means that smaller masses need to be accelerated and decelerated, thus making the use of engines with lots of power and large torque obsolete even though the discontinuous forward motion requires considerable accelerations. On the other side, there are no special requirements for the continuous or discontinuous web supply drive. The packaging machine that fetches the documents in groups determines the cycle time. This mode of operation allows for stopping the cutter after each separation.

An important advantage of the device according to the invention is that the paper webs are guided at any point in time, i.e. they always have contact to some rollers or tubes, whether driven or not, over the whole length of the accumulated material. This leads to a better engine smoothness and ensures that the webs do not have an undesired opportunity to be crinkled or ruptured.

BRIEF DESCRIPTION OF THE DRAWINGS

For a better understanding of the invention and for illustrating of the before mentioned matter the invention is illustrated with reference to drawings.

DETAILED DESCRIPTION

Figure 1:
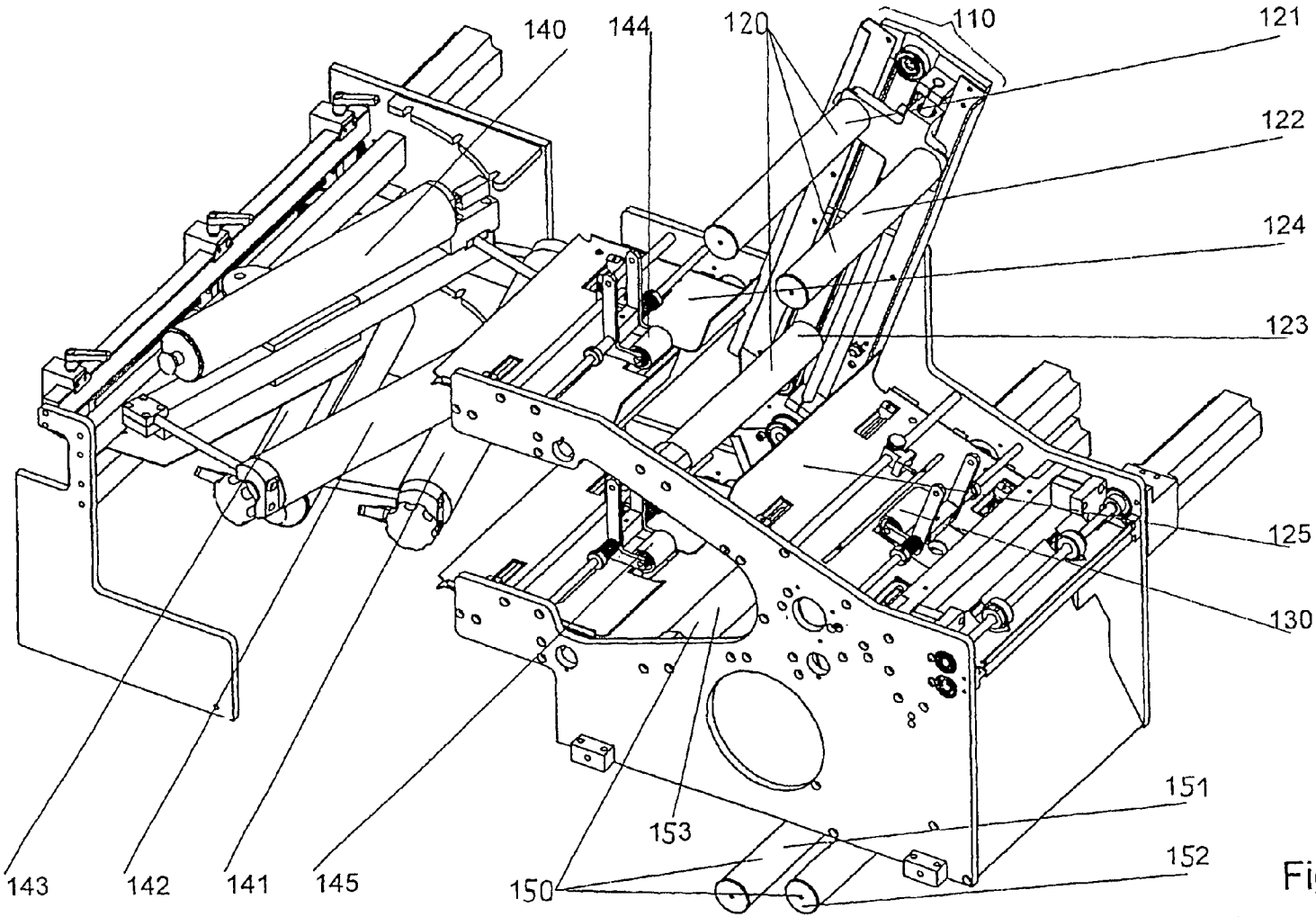
FIG. 1 shows a perspective top view of the buffer region of the device according to the invention.

In the following a preferred embodiment of the invention will be illustrated further in detail with reference to FIG. 1. For this purpose the main part of the invention, the buffer region 110 of the lateral separation device comprising tube groups 120, 150, is illustrated schematically according to a first embodiment in FIG. 1. A longitudinal separating and reading device (not depicted in FIG. 1) is positioned prior to the buffer region 110. The paper web introduced from the left is cut longitudinally, thus forming two partial webs; the web half in front is guided over the paper merger region with tubes 140 and 142, the specific arrangement of these leading to the positioning of the paper webs on top of each other. The same device is located laterally reversed on the lower side. By means of tubes 141 and 143 the rear web half is guided to the lower side. Subsequently, both partial webs are fed to the respective buffer region 110 by means of the drive shafts 144 and 145. The upper buffer region comprises two movable tubes 121 and 122, a static tube 123 and two deflectors, 124 (entry) and 125 (exit), that are also fixed stationarily. Both movable tubes are attached to a slide that effects a movement perpendicular to the paper web. Due to this controlled upward movement both loops can take up as well as release paper. The same device is arranged laterally reversed at the lower web that forms both compensation loops downwards.

The driven roller 130 is the lead-off roller for the synchronized paper forward motion and at the same the feed roller to the cutting device. In a preferred embodiment of the invention the cutting is effected by a pendulum knife (not depicted in FIG. 1) that is located downstream of the synchronized paper forward motion. The procedure of collecting and further processing of the cut paper is not subject-matter of the present invention but known in the state of the art.

If the introduced paper is not to be initially separated longitudinally, it goes without saying that only one half of the inventive device may be used; of course, one has to waive the higher throughput.

Figure 2:
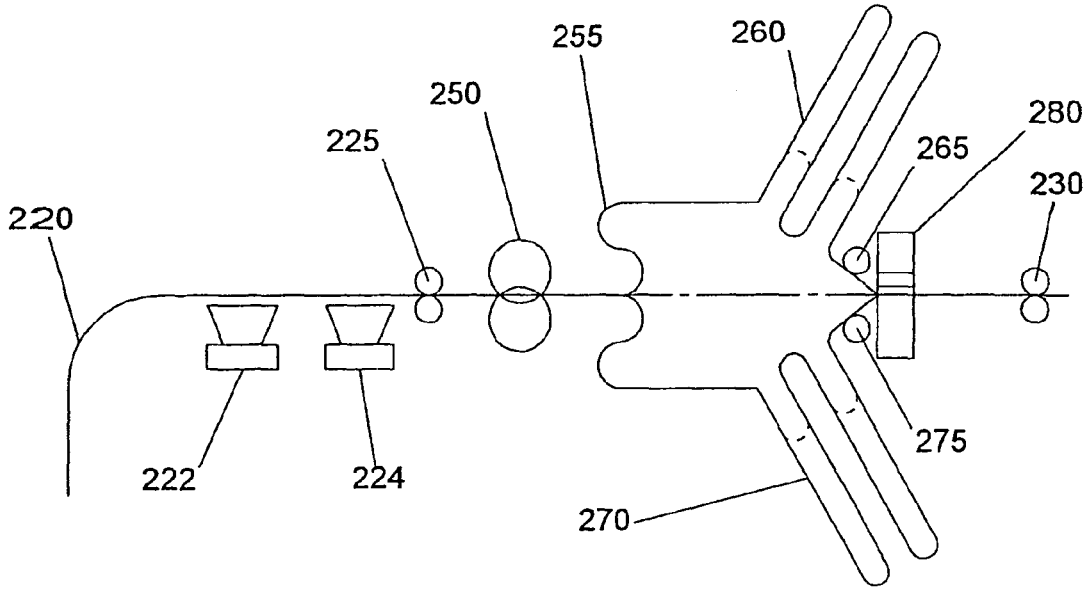
FIG. 2 shows a schematic representation of the operating principle of the inventive device.

In FIG. 2 the mode of operation of the inventive lateral separation device is illustrated. At the inlet 220 the unseparated paper web is introduced. The paper web moves past the read heads 222 and 224, this being effected by the continuous drive 225 with a speed of up to 4 m/s. Then the web is conveyed to the longitudinal and edge cutting device 250. The merging of both partial webs takes place at 225. In buffers 260 and 270 the respective buffering of the partial webs takes place, the forward motion being effected by driven rollers 265 or 275 that can move the paper webs up to 6 m/s. The merged partial webs are then laterally separated by the pendulum knife 280 before pull-off 230 effects the supply of the sections.

Figure 3:
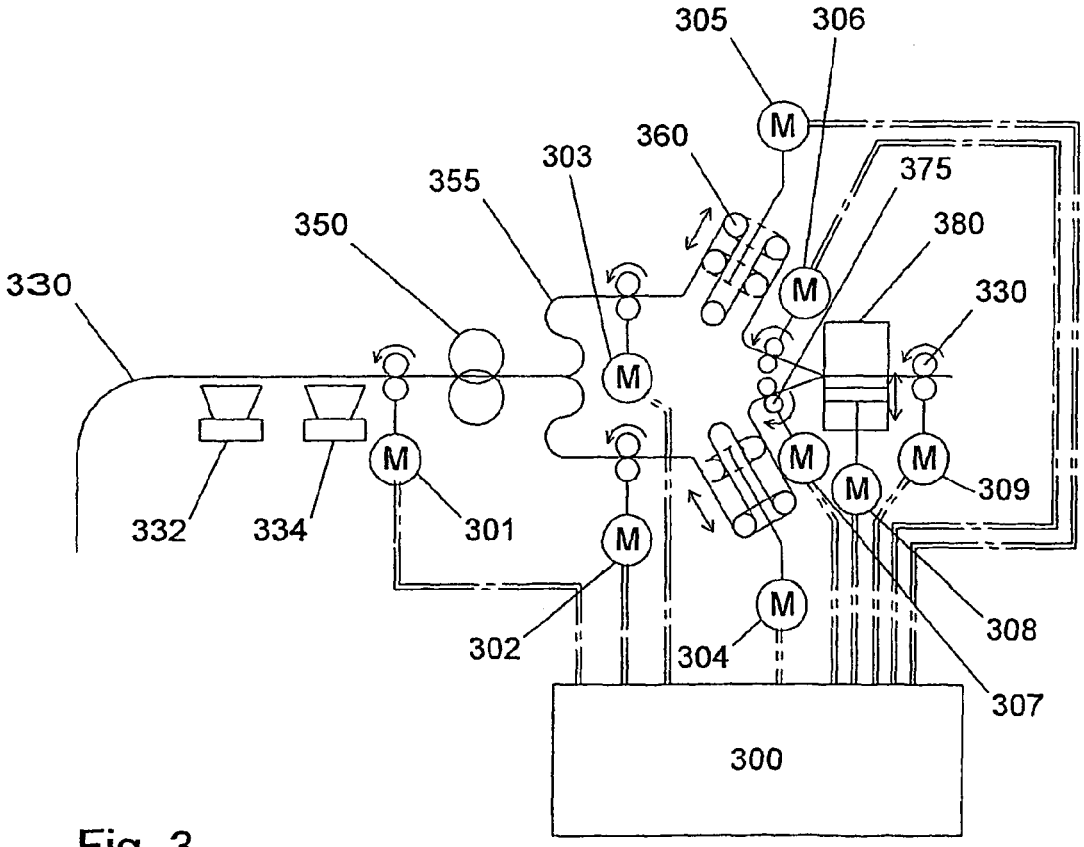
FIG. 3 shows a schematic representation of the controlling principle of the inventive device.

FIG. 3 shows the controller principle of the inventive device. The central controller unit 300 controls and regulates the forward motion of the paper webs that is effected by the various drives 301, . . . , 309. The paper web enters the device at entry 330, passes read heads 332 and 334 and is separated longitudinally at 350. The merging of the partial webs takes place at 355. In buffer 360 the partial web is then accumulated and collected by the forward feed and fed to the pendulum knife. Pull-off 330 removes the paper sections from the device.

Figure 4:
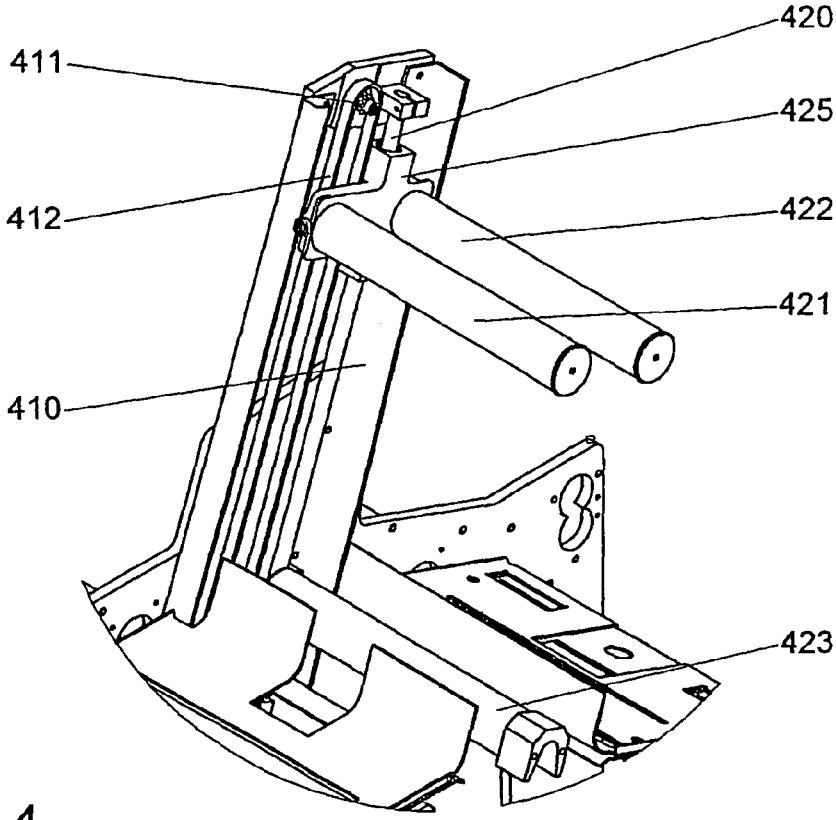
FIG. 4 is an enlarged representation of a paper buffer.

In FIG. 4 a part of the inventive device in the buffer region is enlarged. One recognizes the at least three tubes of a tube group, two of them, tubes 421 and 422, protruding perpendicularly from the device. The tubes can be moved along the guide means 420. Both tubes are arranged on a movable guide piece 425. The guide piece 425 is also moved along the guide means 420 in deflectors 410. The drive for the movement of the guide piece 425 is part of an engine (not depicted) that powers gear wheel 411. By means of belt 412 the motion of the engine is transferred to guide piece 425, thus effecting the movement of tubes 421 and 422. The immobile tube 423 is attached to the front side panel that is not depicted, which in turn is attached to the rear side panel by cross beams.

Figure 5:
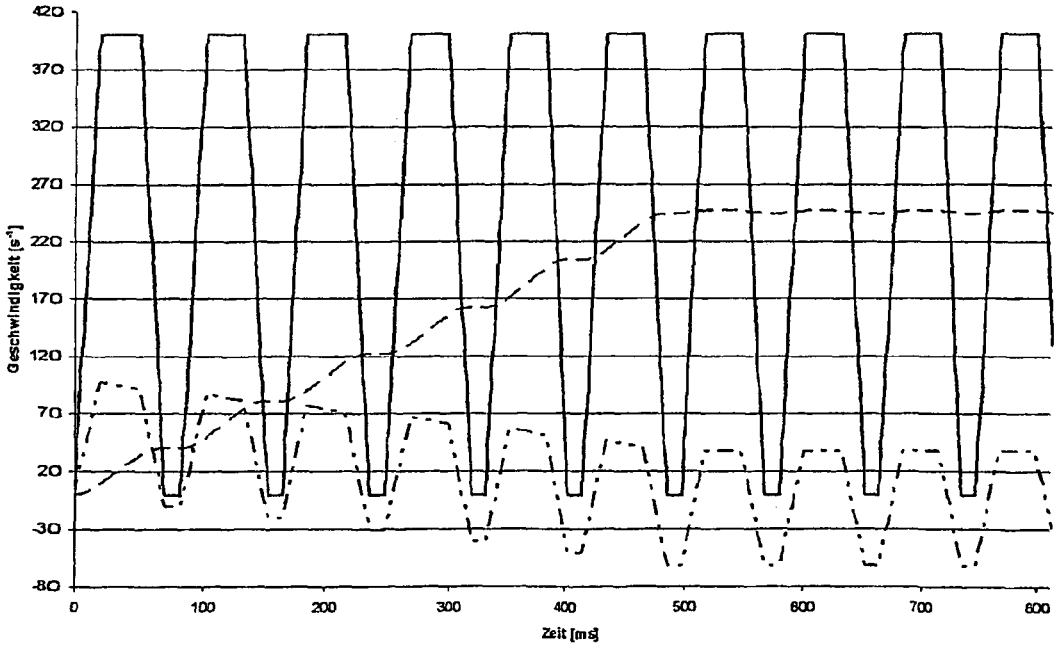
FIG. 5 is a diagram of the time response of the various roller drives.

FIG. 5 is a speed diagram of the forward motion of the paper web(s) in the inventive device, wherein time is the x-coordinate (in ms) and the speed is the y-coordinate (in $s^{-1}$). The median value of the forward motion (dashed line) results from the discontinuous movement of the forward motion (full line) and the action of the paper buffer (dashed dotted line).

Figure 6:
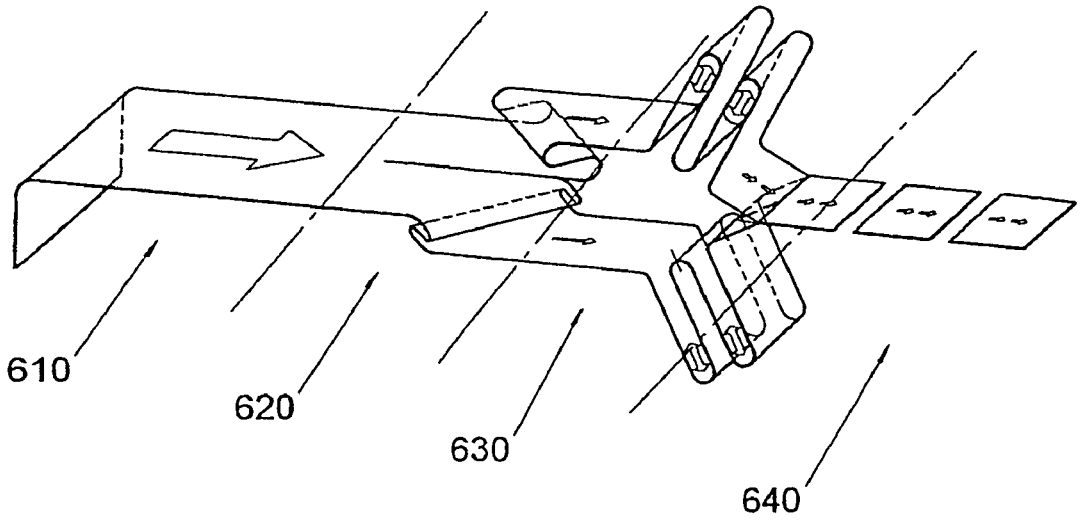
FIG. 6 is a schematic representation of an inventive change in direction of the web in the device.

In FIG. 6 the various phases of the passage of the paper web in the inventive device are illustrated. In the first phase 610 the paper web is still non-separated. After passing the longitudinal cutting device phase 620 follows, where it is separated into two partial webs. Both partial webs are merged and introduced to the buffer phase 630. At the end of buffer phase 630 the lateral separation is effected, initiating the last phase 640. In this phase the paper web is separated into individual sections (documents).

Within the context of the above specific description many modifications are obvious to those skilled in the art. Hence, the scope of protection is determined by interpreting the appended claims.

The invention claimed is:

1. A device for lateral separation of paper webs, comprising:

a paper introduction region with at least one continuously or discontinuously driven web supply roller;

a paper merger region, with merger region tubes;

a buffer region, where a paper web is prepared for discontinuous forward motion, the buffer region comprising a first tube group and a second tube group, each tube group comprising a first tube and a second tube movable, relative to at least a third tube, in a direction perpendicular to the paper web, wherein the first tube group and the second tube group are arranged laterally reversed to each other, between the paper merger region and a discontinuously driven forward motion means, and each tube group processes a paper web;

a paper web lead-off region with discontinuously driven forward motion means;

a cutting device containing a cutting means for cutting the paper web; and a paper web pull-off region with discontinuous web forward motion means, wherein each tube group is arranged between the paper merger region and the discontinuously driven web forward motion means to form a double turned paper web loop of variable length, wherein the distance between the tubes of each tube group corresponds to the length of the paper web loop and is controlled by a controller connected to each continuously or discontinuously driven web supply roller and the discontinuous forward motion means.

2. The device according to claim 1, wherein the device is capable of simultaneously processing two paper webs arranged one on top of the other.

3. The device according to claim 1, wherein none of the tube groups comprises a driven roller.

4. The device according to claim 1, wherein the paper lead-off region comprises at least one discontinuously driven web feed roller for effecting forward motion of the paper webs.

5. The device according to claim 1, wherein the cutting means is a pendulum knife.

* * * * *